US009644339B2

(12) United States Patent
Wada et al.

(10) Patent No.: US 9,644,339 B2
(45) Date of Patent: May 9, 2017

(54) DAMPER OPERATION CONTROL DEVICE AND DAMPER OPERATION CONTROL METHOD FOR WORKING VEHICLE

(75) Inventors: Minoru Wada, Mooka (JP); Toshiyuki Ota, Komatsu (JP)

(73) Assignee: Komatsu Ltd., Tokyo (JP)

( * ) Notice: Subject to any disclaimer, the term of this patent is extended or adjusted under 35 U.S.C. 154(b) by 237 days.

(21) Appl. No.: 13/581,833

(22) PCT Filed: Mar. 1, 2011

(86) PCT No.: PCT/JP2011/054653

§ 371 (c)(1),
(2), (4) Date: Dec. 4, 2012

(87) PCT Pub. No.: WO2011/108550

PCT Pub. Date: Sep. 9, 2011

(65) Prior Publication Data

US 2013/0073151 A1 Mar. 21, 2013

(30) Foreign Application Priority Data

Mar. 5, 2010 (JP) ..... 2010-049723

(51) Int. Cl.
*E02F 3/43* (2006.01)
*E02F 9/22* (2006.01)

(52) U.S. Cl.
CPC ..... *E02F 3/434* (2013.01); *E02F 9/2207* (2013.01); *E02F 9/2217* (2013.01)

(58) Field of Classification Search
CPC ..... E02F 9/2207; E02F 9/2217; E02F 9/2296; E02F 3/434; F15B 1/021; F15B 21/008
(Continued)

(56) References Cited

U.S. PATENT DOCUMENTS 4,476,679 A 10/1984 Sato
5,147,172 A 9/1992 Hosseini
(Continued)

FOREIGN PATENT DOCUMENTS

CN 1717547 A 1/2006
JP 05-209422 A 8/1993
(Continued)

OTHER PUBLICATIONS

International Search Report dated Jun. 7, 2011, issued for PCT/JP2011/054653.

(Continued)

*Primary Examiner* — Basil T Jos
(74) *Attorney, Agent, or Firm* — Locke Lord LLP

(57) ABSTRACT

A damper operation control device of a working vehicle, includes: a boom pivotably supported on a vehicle body; a bucket pivotably supported on a tip end of the boom; a lift cylinder which drives the boom; an accumulator connected to the lift cylinder through a branched oil passage; a switching valve connected to the branched oil passage between the lift cylinder and the accumulator, the switching valve switching between a connected state and a disconnected state between the lift cylinder and the accumulator; and a controller which performs switch control of the switching valve, wherein the controller includes: a state detecting unit which detects whether the bucket is in a loaded state; and a switching valve control unit which switches the switching valve to the connected state when the state detecting unit detects that the bucket is in the loaded state.

11 Claims, 7 Drawing Sheets

(58) Field of Classification Search
USPC ..... 701/50
See application file for complete search history.

(56) References Cited

U.S. PATENT DOCUMENTS

| | | | | |
|---|---|---|---|---|
| 7,445,240 | B2 | 11/2008 | Ichimura et al. | |
| 2007/0056277 | A1* | 3/2007 | Mizoguchi et al. | 60/413 |
| 2007/0299589 | A1* | 12/2007 | Gianoglio et al. | 701/50 |
| 2010/0131158 | A1 | 5/2010 | Saito | |

FOREIGN PATENT DOCUMENTS

| | | | |
|---|---|---|---|
| JP | 2007-162387 | A | 6/2007 |
| JP | 2007-186942 | A | 7/2007 |
| WO | WO-2009019974 | A1 | 2/2009 |

OTHER PUBLICATIONS

European Search Report dated Jul. 12, 2013 for European Application No. EP11750660.0.

* cited by examiner

| | | | |
|---|---|---|---|
| 101 | : BUCKET | 121 | : BUCKET CYLINDER |
| 102 | : BOOM | 121-1 | : TUBE |
| 102-11 | : BOOM ANGLE SENSOR | 121-3 | : PISTON ROD |
| 103 | : FRONT WHEEL | 122 | : FIRST BUCKET LINK |
| 118 | : LIFT CYLINDER | 122-1, 122-3 | : LINK PIN |
| 118-1 | : TUBE | 122-2 | : SUPPORT PIN |
| 118-3 | : PISTON ROD | 122-11 | : BUCKET ANGLE SENSOR |
| 130 | : VEHICLE BODY FRONT FRAME | 123 | : SUPPORT MEMBER |
| | | 124 | : SECOND BUCKET LINK |

DAMPER OPERATION CONTROL DEVICE AND DAMPER OPERATION CONTROL METHOD FOR WORKING VEHICLE

BACKGROUND OF THE INVENTION

Field of the Invention.

The present invention relates to a damper operation control device and a damper operation control method for a working vehicle and especially relates to the damper operation control device and the damper operation control method for the working vehicle such as a wheel loader, a skid-steer loader, a bulldozer, and a excavator.

In general, the working vehicle such as the wheel loader performs work such as excavation by efficiently using force generated by a power supply, so that this is not equipped with a suspension system to absorb vibration generated in a vehicle body. Therefore, there is a defect that a loaded burden (such as earth and sand) falls due to the vibration generated during travel and that riding quality is deteriorated in a conventional working vehicle.

Then, for example, following Patent Literature 1 discloses technology to provide an accumulator connectable to a fluid pressure lift cylinder for lifting a bucket and connect the fluid pressure lift up cylinder to the accumulator only when a vehicle speed of the working vehicle becomes a predetermined value or higher. According to the conventional technology disclosed in Patent Literature 1, it becomes possible to absorb the vibration generated in the vehicle body during the travel by the accumulator connected to the fluid pressure lift cylinder, so that it is possible to prevent the defect such as falling of the loaded burden such as the earth and sand during the travel and deterioration in the riding quality during the travel from generating.

Also, following Patent Literature 2 discloses the technology to improve stability of the working vehicle at the time of the travel by controlling to accumulate pressure in the accumulator according to a vehicle speed and/or an operating position of a forward/reverse lever and by controlling to absorb variation in pressure generated in a bottom chamber in a boom cylinder.

CITATION LIST

Patent Literature

Patent Literature 1: Japanese Patent Application Laid-open No. H05-209422

Patent Literature 2: Japanese Patent Application Laid-open No. 2007-186942

BRIEF SUMMARY OF THE INVENTION

Technical Problem

However, when use of the accumulator is switched according only to the vehicle speed and the operating position of the forward/reverse lever as in the above-described conventional technology, there is a case in which connection between the accumulator and the bottom chamber is released irrespective of whether the burden is loaded in the bucket, and there is a problem that the burden loaded in the bucket might be fallen in this case.

The present invention is achieved in view of the above description and an object thereof is to provide the damper operation control device and the damper operation control method for the working vehicle capable of efficiently using the force generated by the power supply and of realizing decrease in the falling of the loaded burden and improvement in the riding quality.

Solution to Problem

To overcome the problems and achieve the object, according to the present invention, a damper operation control device of a working vehicle, comprises: a boom pivotably supported on a vehicle body; a bucket pivotably supported on a tip end of the boom; a lift cylinder which drives the boom; an accumulator connected to the lift cylinder through a branched oil passage; a switching valve connected to the branched oil passage between the lift cylinder and the accumulator, the switching valve switching between a connected state and a disconnected state between the lift cylinder and the accumulator; and a controller which performs switch control of the switching valve, wherein the controller includes: a state detecting unit which detects whether the bucket is in a loaded state; and a switching valve control unit which switches the switching valve to the connected state when the state detecting unit detects that the bucket is in the loaded state.

According to the present invention, the switching valve control unit switches the switching valve to the connected state when the working vehicle travels at a speed not lower than a predetermined speed when the state detecting unit detects that the bucket is in a state other than the loaded state, and the switching valve control unit switches the switching valve to the connected state even when the working vehicle travels at a speed lower than the predetermined speed when the state detecting unit detects that the bucket is in the loaded state.

According to the present invention, a damper operation control method for a working vehicle comprises: a boom pivotably supported on a vehicle body; a bucket pivotably supported on a tip end of the boom; a lift cylinder which drives the boom through a branched oil passage; an accumulator connected to the lift cylinder; a switching valve connected to the branched oil passage between the lift cylinder and the accumulator, the switching valve switching between a connected state and a disconnected state between the lift cylinder and the accumulator; and a controller which performs switch control of the switching valve, the method comprising: detecting whether the bucket is in a loaded state; and switching the switching valve to the connected state when the bucket is detected to be in the loaded state in the detecting.

According to the present invention, the working vehicle further includes a transmission for driving, the detecting includes detecting a transition state of at least an unladen state, a state during excavation work, and the loaded state as a working state of the working vehicle and detecting that a current working state of the working vehicle is the loaded state when a bottom pressure of the lift cylinder is detected to be not lower than predetermined unladen pressure for determining that a burden is not loaded in the bucket and an angle of the boom is detected to be smaller than a predetermined angle set in advance or when the bottom pressure of the lift cylinder is detected to be not lower than the predetermined unladen pressure and a direction of the bucket is detected to be horizontal or above a horizontal plane in a case that the current working state of the working vehicle is the unladen state, or when an operation signal to the transmission is detected to be other than forward in a case that the current working state of the working vehicle is the state during the excavation work.

Advantageous Effects of Invention

According to the present invention, the switching valve is switched to the connected state to activate the damper mechanism when the bucket is detected to be in the loaded state, so that it is possible to realize the damper operation control device and the damper operation control method for the working vehicle capable of efficiently using the force generated by the hydraulic pump and of realizing the decrease in the falling of the loaded burden and the improvement in the riding quality.

DETAILED DESCRIPTION OF THE INVENTION

Figure 1:
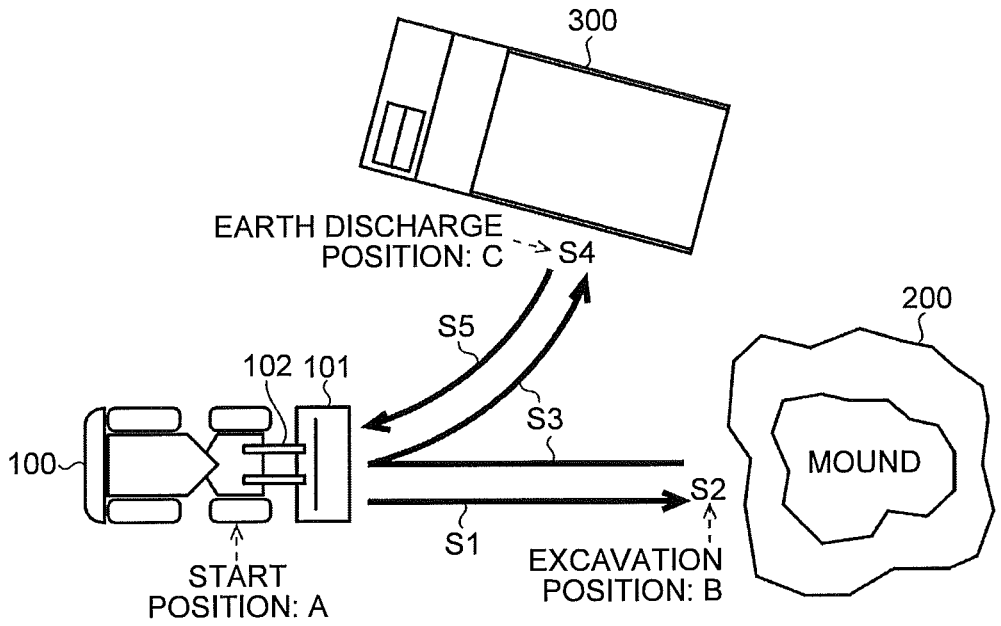
FIG. 1 is a schematic diagram illustrating a schematic flow of loading work illustrated in one embodiment of the present invention.

An embodiment for carrying out the present invention is hereinafter described in detail with reference to the drawings. Meanwhile, in a following description, the drawings merely schematically illustrate a shape, a size, and positional relationship such that contents of the present invention may be understood, so that the present invention is not limited only to the shape, the size, and the positional relationship illustrated in the drawings. Also, a value illustrated in the following description is merely a preferable example of the present invention, so that the present invention is not limited to the illustrated value.

A damper operation control device and a damper operation control method for a working vehicle according to one embodiment of the present invention are hereinafter described in detail with reference to the drawings. Meanwhile, in this embodiment, a wheel loader 100 is described as an example of the working vehicle as illustrated in FIG. 1, and a case in which earth and sand are loaded from a mound 200 into a dump truck 300 using the wheel loader 100 is described.

FIG. 1 is a schematic diagram illustrating a schematic flow of loading work described as an example in this embodiment. As illustrated in FIG. 1, the wheel loader 100 is provided with a bucket 101, which performs work such as excavation and work to load a burden to carry, and a boom 102, which lifts the bucket 101.

In an example illustrated in FIG. 1, the wheel loader 100 is first arranged in a start position A and moves forward from the start position A to the mound 200 to move to an excavation position B (step S1). Subsequently, the wheel loader 100 tilts the bucket 101 at least once with operation of the boom 102 while moving forward in the excavation position B, thereby scooping the earth and sand from the mound 200 by using the bucket 101 (step S2). Next, the wheel loader 100 moves backward and then turns to move forward, thereby moving to an earth discharge position C beside a loading platform of the dump truck 300 (step S3). Subsequently, the wheel loader 100 puts the boom 102 into a vertical or substantially vertical standing position in the earth discharge position C and dumps the bucket 101 in this state, thereby discharging the earth and sand in the bucket 101 into the loading platform of the dump truck 300 (step S4). Thereafter, the wheel loader 100 moves backward while turning, thereby moving to its original start position A (step S5). Thereafter, the wheel loader 100 repeats steps S1 to S5, thereby loading a target amount of earth and sand of the mound 200 into the loading platform of the dump truck 300.

Figure 2:
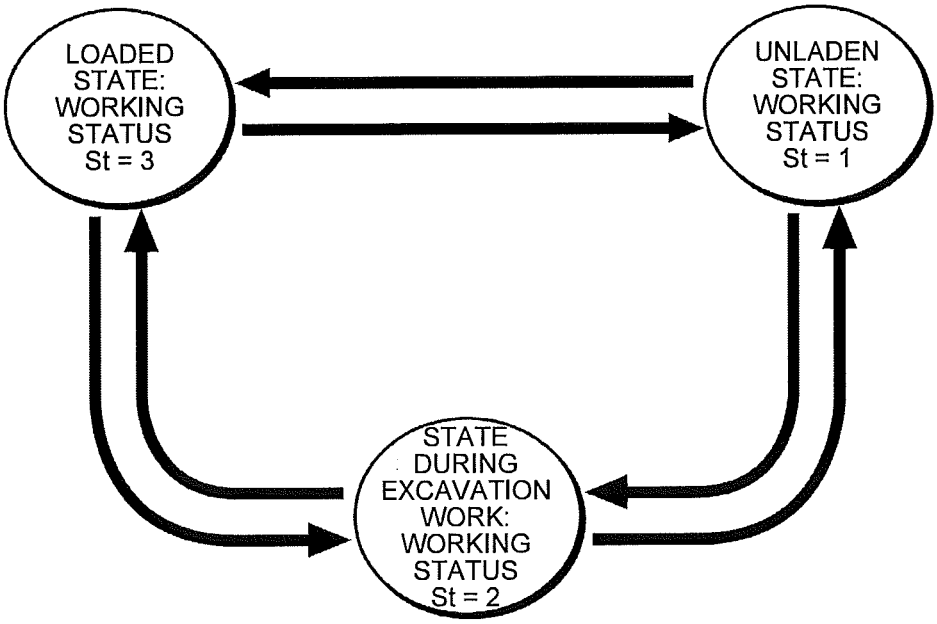
FIG. 2 is a schematic diagram illustrating transition of a working state of a wheel loader according to one embodiment of the present invention.

In the above-described loading work, as illustrated in FIG. 2, a working state of the wheel loader 100 transits among an unladen state (working status St=1), a state during the excavation work (working status St=2), and a loaded state (working status St=3). The unladen state (St=1) is the state in which the burden is not loaded in the bucket 101. The state during the excavation work (St=2) is the state in which the wheel loader 100 performs the work to load the burden in the bucket 101 by operating the boom 102 and/or the bucket 101 while moving forward. The loaded state (St=3) is the state in which the burden is loaded in the bucket 101. FIG. 2 is a schematic diagram for illustrating transition of the working state of the wheel loader 100 according to this embodiment.

Figure 3:
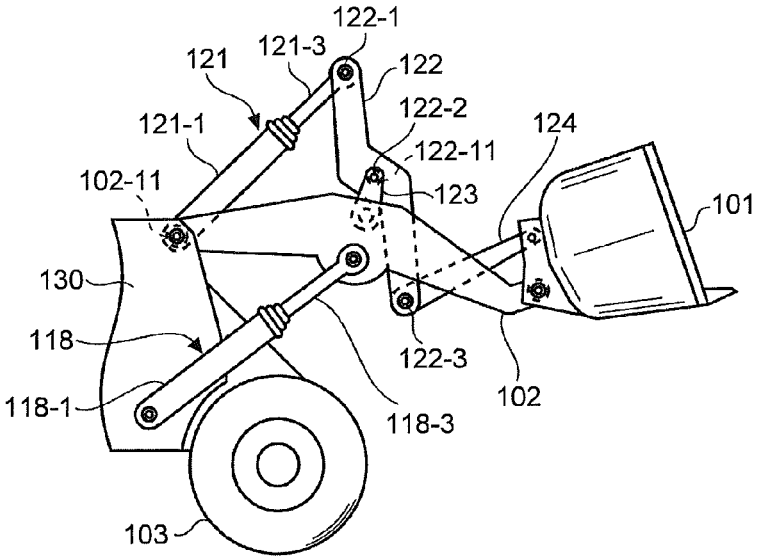
FIG. 3 is a side view illustrating a detailed configuration of the wheel loader according to one embodiment of the present invention.

Herein, when describing a transition condition among the working states (St=1 to St=3), a detailed configuration of the wheel loader 100 according to this embodiment is described with reference to the drawings. FIG. 3 is a side view for illustrating the detailed configuration of the wheel loader 100. In FIG. 3, only a part of the wheel loader 100 on a front wheel 103 side related to the following description is selectively illustrated.

As illustrated in FIG. 3, the wheel loader 100 is provided with the bucket 101, the boom 102, a lift cylinder 118, a bucket cylinder 121, a first bucket link 122, and a second bucket link 124.

The bucket 101 is a so-called shovel for excavating to scoop the burden such as the earth and sand. The boom 102 is a support column for moving the bucket 101 in a height direction of which one end is pivotably supported on a vehicle body front frame 130 by means of a pivot pin. A bottom part of the bucket 101 is pivotably attached to the other end of the boom 102 by means of the pivot pin.

The lift cylinder 118 is configured to drive the boom 102 and includes a tube 118-1 of which one end is pivotably attached to the vehicle body front frame 130 in a position different from that of the boom 102 by means of the pivot pin and a piston rod 118-3 slidably fitted into the other end of the tube 118-1. The lift cylinder 118 expands and contracts by insertion and removal of the piston rod 118-3 to and from the tube 118-1 by hydraulic pressure. Meanwhile, a middle part of the boom 102 is rotatably attached to a tip end of the piston rod 118-3 by means of the pivot pin. Therefore, the boom 102 rotates around the pivot pin fitted onto the vehicle body front frame 130 by expansion and contraction of the lift cylinder 118.

For example, when the lift cylinder 118 expands, the boom 102 rotates in a counterclockwise direction in the drawing around the pivot pin as a pivot, and as a result, the end of the boom 102 opposite to the end pivotably supported rises and the bucket 101 attached thereto rises. On the other hand, when the lift cylinder 118 contracts, the boom 102 rotates in a clockwise direction in the drawing around the pivot pin as the pivot, and as a result, the end of the boom 102 opposite to the end pivotably supported lowers and the bucket 101 attached thereto lowers.

The bucket cylinder 121 is composed of a tube 121-1 of which one end is pivotably attached to the vehicle body front frame 130 in the same position as that of the boom 102, for example, by means of the pivot pin and a piston rod 121-3 slidably fitted into the other end of the tube 121-1, and expands and contracts by the insertion and the removal of the piston rod 121-3 to and from the tube 121-1 by the hydraulic pressure. One end of the first bucket link 122 is rotatably attached to a tip end of the piston rod 121-3 by means of a link pin 122-1. A middle part of the first bucket link 122 is rotatably attached to a support member 123 fixed to the middle part of the boom 102 by means of a support pin 122-2. One end of the second bucket link 124 is rotatably attached to the other end of the first bucket link 122 by means of a link pin 122-3. The other end of the second bucket link 124 is rotatably attached to the bottom part of the bucket 101 in a position different from that of the boom 102 by means of the pivot pin. Therefore, when the bucket cylinder 121 expands and contracts, displacement thereof is transmitted to the bucket 101 through the first bucket link 122 and the second bucket link 124, and according to this, the bucket 101 rotates around the pivot pin fitted onto the boom 102.

For example, when the bucket cylinder 121 expands by increase in the hydraulic pressure, the first bucket link 122 rotates in the clockwise direction in the drawing around the support pin 122-2 as the pivot, and according to this, the link pin 122-3 of the second bucket link 124 is pulled in a direction toward the vehicle body front frame 130. As a result, the bucket 101 rotates in the counterclockwise direction in the drawing around the pivot pin connected to the boom as the pivot. On the other hand, when the bucket cylinder 121 contracts, a direction of the bucket 101 rotates in the clockwise direction in the drawing.

By driving the lift cylinder 118 and the bucket cylinder 121 in the above-described manner, a height from a ground surface and the direction of the bucket 101 are operated. Meanwhile, in this embodiment, the term "direction of the bucket 101 (hereinafter, referred to as a bucket direction)" is used by setting such that the bucket in a state suitable for performing the excavation work is in a horizontal direction. Specifically, in a case in which the wheel loader 100 is on a horizontal ground surface, it is possible to determine that the direction of the bucket 101 is in the horizontal direction by a direction of the bottom part (surface on a side in contact with the ground surface) of the bucket 101, a direction of a tooth (small piece indicated on a front-lower part of the bucket in the drawing) attached to the bucket 101, or a direction in which an opening of the bucket 101 in a tray shape faces.

A boom angle sensor 102-11, which detects an attitude of the boom 102 (for example, an elevation angle: hereinafter, referred to as a boom angle) is provided on the end of the boom 102 on the vehicle body front frame 130 side. The detected boom angle is input to a controller 111 (refer to FIG. 4) to be described later. Meanwhile, in this embodiment, the boom angle indicates the angle (elevation angle) between a straight line connecting the pivot pin, which is the pivot of the boom 102, and the pivot pin, which is the pivot of the bucket 101, and a horizontal plane when the end supported on the vehicle body front frame 130 of the boom 102 is set to a start point, for example. However, the angle is not limited thereto and may be variously modified such as an angle with respect to a vertical direction, for example.

Further, a bucket angle sensor 122-11 for detecting an angle between the bucket 101 and the boom 102 is provided on the middle part of the first bucket link 122 in a position in which the support pin 122-2 is provided. The bucket angle sensor 122-11 detects a rotational angle of the first bucket link 122 with respect to a reference, which is a longitudinal direction of the boom 102, for example. The detected rotational angle is input to the controller 111 (refer to FIG. 4) to be described later as a bucket angle. The controller 111 calculates the direction of the bucket 101 (bucket direction) from the boom angle and the bucket angle, which are input.

Figure 4:
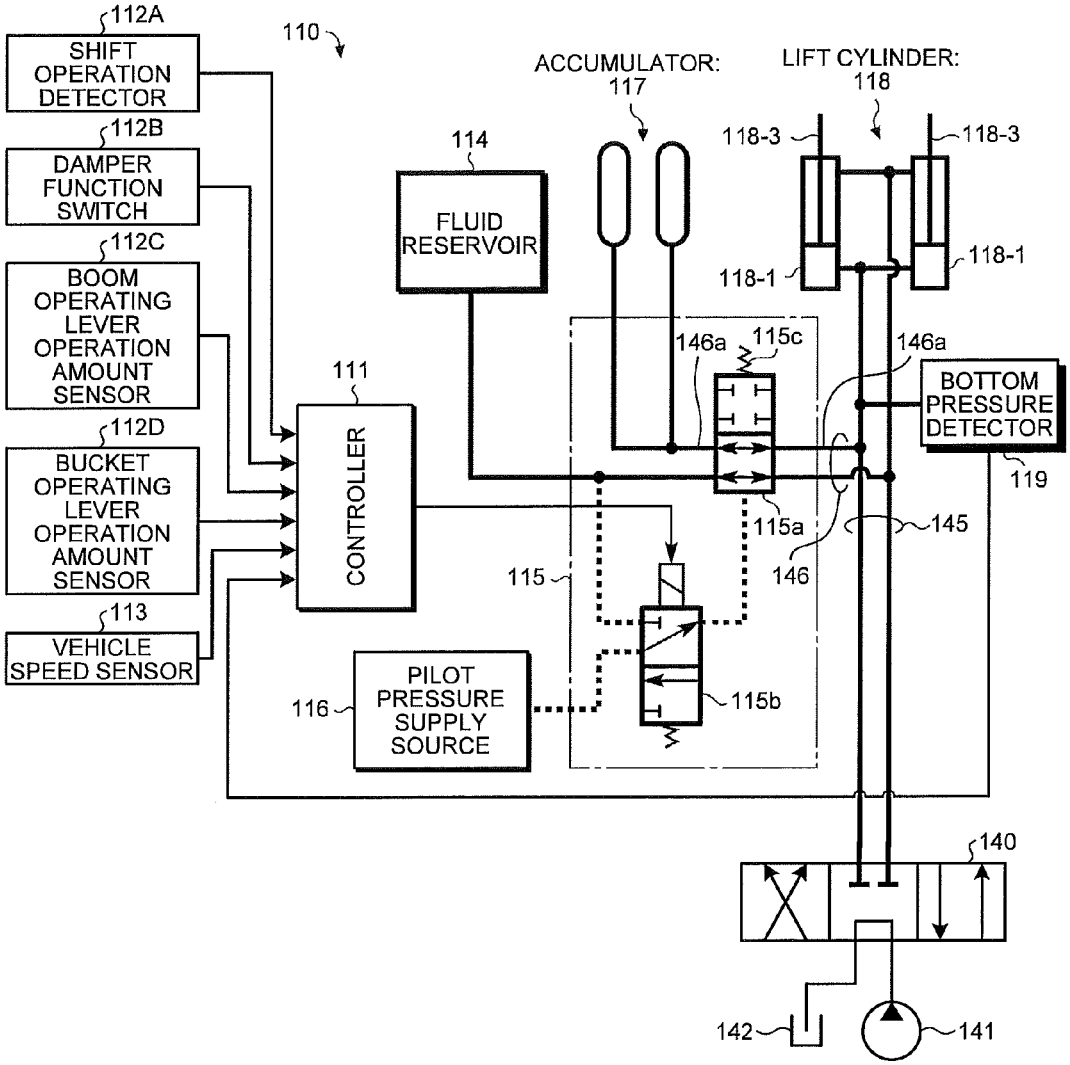
FIG. 4 is a block diagram illustrating a schematic configuration of a damper operation control device according to one embodiment of the present invention.

Subsequently, an extract of a configuration of a damper operation control device 110 equipped on the wheel loader 100 according to this embodiment is described in detail with reference to the drawings. FIG. 4 is a block diagram illustrating a schematic configuration of the damper operation control device 110 according to this embodiment. As illustrated in FIG. 4, the damper operation control device 110 includes the controller 111, a shift operation detector 112A, a damper function switch 112B, a boom operating lever operation amount sensor 112C, a bucket operating lever operation amount sensor 112D, a vehicle speed sensor 113, a fluid reservoir 114, a valve system 115 including a switching valve 115*a* and an EPC (electromagnetic proportional control) valve 115*b*, a pilot pressure supply source 116, an accumulator 117, at least one lift cylinder 118, each of which includes the tube 118-1 and the piston rod 118-3, and a bottom pressure detector 119. In this configuration, the fluid reservoir 114, the valve system 115 including the switching valve 115*a* and the EPC valve 115*b*, and the accumulator 117 serve as a damper mechanism, which decreases vibration of the lift cylinder 118. Meanwhile, a hydraulic pump 141, which discharges hydraulic oil, and a tank 142 are connected to the lift cylinder 118 through an operating valve 140. The lift cylinder 118 expands and contracts by supply and switch of a direction of supply of the hydraulic oil by operation of the operating valve 140. Main oil passages 145 connect the lift cylinder 118 and the operating valve 140. Branched oil passages 146 branched from the main oil passages 145 are connected to the accumulator 117 and the fluid reservoir 114. The switching valve 115*a* is provided in the middle of the branched oil passages 146. The accumulator 117 is connected to the lift cylinder 118 through a branched oil passage 146*a* out of the branched oil passages 146 and an oil passage on a bottom side of the main oil passages 145.

The shift operation detector 112A is provided on a shift lever mechanism, which operates a transmission of the wheel loader 100, and detects a current operating position indicating forward (F)—neutral (N)—reverse (R) and any of speed stages from first to fourth speeds in the shift lever mechanism to output a shift operation signal indicating the current operating position to the controller 111. The damper function switch 112B is the switch, which switches between activation/deactivation of the damper function, operated by an operator and outputs a damper function SW signal indicating whether the damper function is activated (ON) or deactivated (OFF) by the operator to the controller 111. The boom operating lever operation amount sensor 112C detects an operational angle of the boom operating lever operated by the operator (boom lever stroke) and outputs a boom lever stroke signal indicating a boom lever stroke amount to the controller 111. The bucket operating lever operation amount sensor 112D detects the operational angle of the bucket operating lever operated by the operator (bucket lever stroke) and outputs a bucket lever stroke signal indicating a bucket lever stroke amount to the controller 111. The vehicle speed sensor 113 always detects a current vehicle speed of the wheel loader 100 and outputs a vehicle speed signal indicating the detected vehicle speed to the controller 111. The bottom pressure detector 119 detects the hydraulic pressure on the bottom side of the lift cylinder 118 (hereinafter, referred to as boom bottom pressure) and outputs a boom bottom pressure signal indicating the detected boom bottom pressure to the controller 111.

The controller 111 is composed of an information processing unit such as a CPU (central processing unit) and an MPU (micro processing unit), for example, and generates a damper drive signal, which is a control signal for opening and closing the EPC valve 115*b* in the valve system 115, from the shift operation signal, the damper function SW signal, the boom lever stroke signal, the bucket lever stroke signal, the vehicle speed signal, and the boom bottom pressure signal, which are input, to output to the EPC valve 115*b*.

The pilot pressure supply source 116 supplies the hydraulic pressure to operate the switching valve 115*a*. The EPC valve 115*b* is connected between the pilot pressure supply source 116 and the switching valve 115*a*. When the damper drive signal for controlling to "open" is input from the controller 111 to the EPC valve 115*b*, this permits conduction between the pilot pressure supply source 116 and the switching valve 115*a* and guides pressurized fluid from the pilot pressure supply source 116 (pilot oil) to the switching valve 115*a* as a hydraulic pilot signal. On the other hand, when the damper drive signal for controlling to "close" is input from the controller 111 to the EPC valve 115*b*, this blocks the conduction between the pilot pressure supply source 116 and the switching valve 115*a* to prevent the pressurized fluid from the pilot pressure supply source 116 from being guided to the switching valve 115*a*. When the switching valve 115*a* and the fluid reservoir 114 are connected to each other, the switching valve 115*a* discharges pressurized oil to the fluid reservoir 114 by an action of a spring provided on a side opposite to a side on which the hydraulic pilot signal is applied to move to a pressed-down position in the drawing.

The switching valve 115*a* is a so-called pilot operated valve for opening and closing connection between the lift cylinder 118 and the accumulator 117 and controls the conduction between the piston rod 118-3 side of the lift cylinder 118 and the fluid reservoir 114 and the conduction between the tube 118-1 side of the lift cylinder 118 and the accumulator 117 according to the hydraulic pilot signal input through the EPC valve 115*b*. For example, when the hydraulic pilot signal (pressurized fluid) is input, the switching valve 115*a* moves in a direction to contract a spring 115*c* by the pressurized fluid, which flows in. As a result, the switching valve 115*a* is put into an open state and the conduction between the piston rod 118-3 and the fluid reservoir 114 and the conduction between the tube 118-1 and the accumulator 117 are permitted. According to this, the hydraulic oil on the lift cylinder 118 side may flow into and out of the fluid reservoir 114 and the accumulator 117. In this manner, by allowing the hydraulic oil on the lift cylinder 118 side to flow into and out of the accumulator 117, it becomes possible to allow the accumulator 117 to absorb the vibration generated in the wheel loader 100, especially, the boom 102.

Meanwhile, the fluid reservoir 114 is a tank, which reserves the hydraulic oil being a medium for transmitting the drive force to the lift cylinder 118 and the bucket cylinder 121. The accumulator 117 is the accumulator, which serves as an escape of the pressurized oil on the tube 118-1 side.

In the wheel loader 100 configured in the above-described manner, the transition condition among the working states (St=1 to St=3) illustrated in FIG. 2 is described in detail with reference to Table 1 illustrated below. Table 1 is the table illustrating the transition condition among the working states according to this embodiment.

TABLE 1

| Current | Current | Transition condition | | | | Destination |
|---|---|---|---|---|---|---|
| working state | working status | Boom bottom pressure | Boom angle | Bucket direction | Shift operation signal | working status |
| Unladen state | 1 | Not lower than predetermined impact pressure | — | — | — | 2 |
| | | Not lower than predetermined unladen pressure | Smaller than predetermined angle | — | — | 3 |
| | | Not lower than predetermined unladen pressure | — | Horizontal or above horizontal plane | — | 3 |
| State during excavation work | 2 | Lower than predetermined unladen pressure | — | — | — | 1 |
| | | — | — | — | Other than F signal | 3 |
| Loaded state | 3 | Not lower than predetermined impact pressure | — | — | — | 2 |
| | | — | Not smaller than predetermined angle | Horizontal or below horizontal plane | — | 1 |
| | | Lower than predetermined unladen pressure | — | | — | 1 |

As illustrated in Table 1, parameters of the transition condition taken into consideration when the working state transits include the boom bottom pressure, the boom angle, the bucket direction, and the shift operation signal.

The boom bottom pressure is the boom bottom pressure detected by the bottom pressure detector 119. Herein, in Table 1, the predetermined unladen pressure is the boom bottom pressure detected in a state in which the burden is not loaded in the bucket 101. The predetermined impact pressure is the pressure generated by an impact of entry of the bucket 101 to the mound 200 at the time of the excavation. The predetermined impact pressure is sufficiently higher than the predetermined unladen pressure. Although the boom bottom pressure increases in association with a rise of the boom 102 at the time of loading of the burden into the dump truck 300 and the like, the predetermined impact pressure is set to the pressure higher than maximum pressure by the rise.

The boom angle (attitude) is the angle of elevation of the boom 102 with respect to the horizontal plane in a case in which the pivot (pivot pin) on the vehicle body front frame 130 side is set to the start point, for example, as described above. Herein, in Table 1, the predetermined angle is the angle of the boom 102 when the height of the bucket 101 during travel is supposed to be highest. The predetermined angle is generally set to the angle above the horizontal plane by several tens of degrees (for example, 20 degrees).

The bucket direction is the direction in which the opening of the bucket 101 in the tray shape faces as described above. As described above, the shift operation signal is the signal indicating the current operating position of the shift lever mechanism. Meanwhile, the shift lever mechanism indicates forward (F)—neutral (N)—reverse (R) and any of the speed stages from the first to fourth speeds of the transmission, so that two types of signals of forward/reverse and speed stages are mixed in the shift operation signal. However, the speed stages other than forward and the first speed stage (F1) may be optional in this description, so that the speed stage is not referred to unless it is required.

In a case in which the current working state is the unladen state (current working status St=1), the working state of the wheel loader 100 transits to the state during the excavation work (destination working status St=2) on the condition that the boom bottom pressure not lower than the predetermined impact pressure is detected. The working state of the wheel loader 100 in the unladen state transits to the loaded state (destination working status St=3) on the condition that the boom bottom pressure is not lower than the predetermined unladen pressure and the boom angle is smaller than the predetermined angle or that the boom bottom pressure is not lower than the predetermined unladen pressure and the bucket direction is horizontal or above the horizontal plane.

When the current working state is the state during the excavation work (current working status St=2), the working state of the wheel loader 100 transits to the unladen state (destination working status St=1) on the condition that the boom bottom pressure is lower than the predetermined unladen pressure. The working state of the wheel loader 100 in the state during the excavation work transits to the loaded state (destination working status St=3) on the condition that the shift operation signal is other than the F signal indicating forward.

Further, in a case in which the current working state is the loading work (current working status St=3), the working state of the wheel loader 100 transits to the state during the excavation work (destination working status St=2) on the condition that the boom bottom pressure not lower than the predetermined impact pressure is detected. The working state of the wheel loader 100 in the loaded state transits to the unladen state (destination working status St=1) on the condition that the boom angle is not smaller than the predetermined angle and the bucket direction is horizontal or below the horizontal plane or that the boom bottom pressure is lower than the predetermined unladen pressure.

In this manner, in this embodiment, the controller 111 detects whether it is in the state in which the burden is loaded in the bucket 101 based on the values detected by the bottom pressure detector 119, the boom angle sensor 102-11, the bucket angle sensor 122-11, and the shift operation detector 112A and the transition condition (Table 1).

Figure 5:
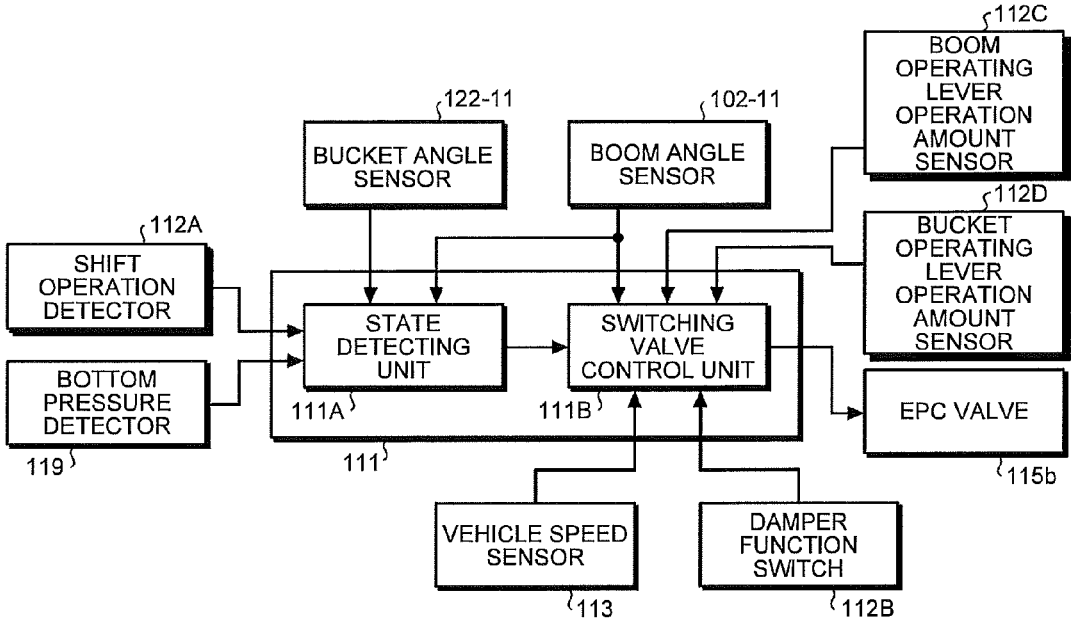
FIG. 5 is a schematic diagram illustrating a specific example of a controller according to this embodiment.

Next, a specific example of the controller 111 according to this embodiment is described in detail with reference to the drawings. FIG. 5 is a schematic diagram illustrating the specific example of the controller 111 according to this embodiment.

As illustrated in FIG. 5, the shift operation signal is input from the shift operation detector 112A to the controller 111. The damper function SW signal indicating whether the damper function is activated (ON) or deactivated (OFF) by the operator is input from the damper function switch 112B to the controller 111. The boom lever stroke signal is input from the boom operating lever operation amount sensor 112C to the controller 111. The bucket lever stroke signal is input from the bucket operating lever operation amount sensor 112D to the controller 111. In addition to this, the boom bottom pressure signal indicating the boom bottom pressure detected by the bottom pressure detector 119, the vehicle speed signal indicating the vehicle speed measured by the vehicle speed sensor 113, a boom angle detection signal indicating the boom angle detected by the boom angle sensor 102-11, and a bucket direction detection signal indicating the bucket direction detected by the bucket angle sensor 122-11 are also input to the controller 111.

The controller 111 includes a state detecting unit 111A, which detects the current working state, and a switching valve control unit 111B, which turns on/off the damper function, that is to say, which performs switch control of the switching valve 115*a* to switch between a connected state (open) and a disconnected state (close) between the lift cylinder 118 and the accumulator 117. The state detecting unit 111A detects the current working state according to Table 1 described above based on the shift operation signal, the boom bottom pressure signal, the boom angle detection signal, and the bucket direction detection signal out of the signals input to the controller 111 to output a detection result to the switching valve control unit 111B.

The detection result by the state detecting unit 111A, the boom angle detection signal, the boom lever stroke signal, the bucket lever stroke signal, the vehicle speed signal from the vehicle speed sensor 113, and the damper function SW signal from the damper function switch 112B are input to the switching valve control unit 111B. The switching valve control unit 111B generates the damper drive signal to turn on or off the damper function based on the input various signals and outputs the damper drive signal to a solenoid coil for opening and closing the EPC valve 115*b* in the valve system 115 (refer to FIG. 4). Meanwhile, to turn on the damper function is to output the damper drive signal for controlling to "open" to the switching valve 115*a* for permitting the conduction between the pilot pressure supply source 116 and the switching valve 115*a* and to turn off the damper function is to output the damper drive signal for controlling to "close" to the switching valve 115*a*.

Figure 6:
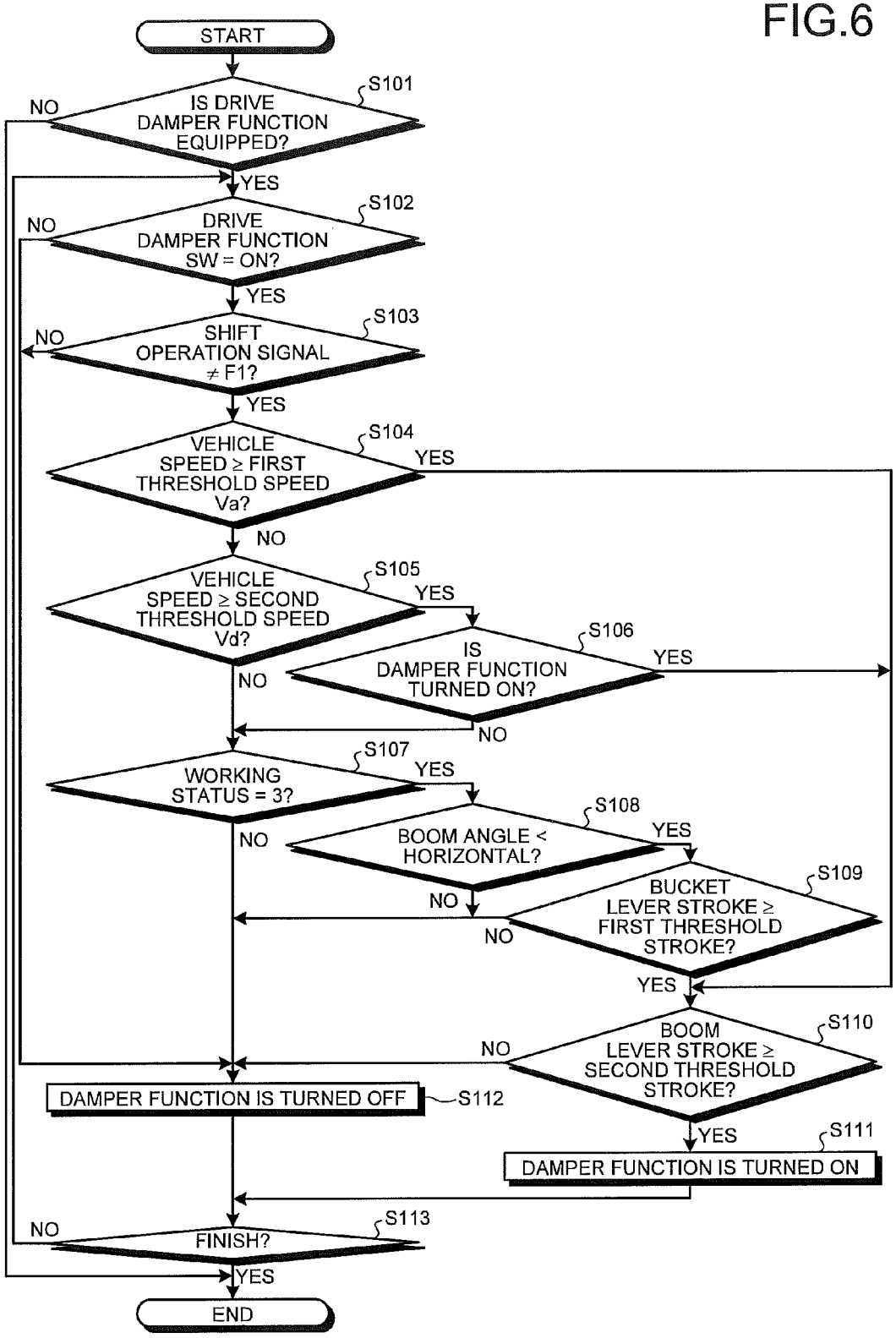
FIG. 6 is a flowchart illustrating schematic operation of a damper operation control method according to one embodiment of the present invention.

Next, the damper operation control method according to this embodiment is described in detail with reference to the drawings. Meanwhile, it is described focusing on operation of the controller 111 in the following description. FIG. 6 is a flowchart illustrating schematic operation of the damper operation control method according to this embodiment. This operation may be configured to start together with a start of a power supply (for example, engine) of the working vehicle in this embodiment and stops together with a stop of the power supply unless particularly instructed to stop.

As illustrated in FIG. 6, the controller 111 first determines whether the wheel loader 100 is equipped with the damper function (step S101), and finishes this operation when this is not equipped with the damper function (step S101, No) or shifts to next step S102 when this is equipped with the damper function (step S101, Yes). Meanwhile, as for whether the wheel loader 100 is equipped with the damper function, a variety of configurations such as a configuration in which this is registered in advance in a memory not illustrated, for example, may be applied.

Next, the controller 111 determines whether the damper function switch 112B is turned on (step S102) and shifts to step S112 to turn off the damper function when this is not turned on (step S102, No). On the other hand, when the damper function switch 112B is turned on (step S102, Yes), this shifts to step S103. Meanwhile, steps S101 and S102 are the steps provided according to the embodiment (for example, the working vehicle without the damper function switch 112B).

The controller 111 determines whether a current speed stage is other than a predetermined stage (F1) at step S103. The wheel loader 100 is generally operated by using the speed stage not lower than the second speed irrespective of forward/reverse, and the forward first speed is used when performing the excavation work. At the time of the excavation work, when the damper mechanism is turned off for improving working efficiency, relative movement between the vehicle body and a working machine is eliminated and the efficiency is improved. Therefore, it is determined whether the shift operation signal is other than the forward first speed (F1) and when this is "F1" (step S103, No), the procedure shifts to step S112 to turn off the damper function. On the other hand, when the current speed stage is other than the forward first speed (step S103, Yes), the procedure shifts to next step S104 for further determining whether to activate the damper mechanism.

At step S104, the controller 111 determines whether the vehicle speed is not lower than a first threshold speed Va, and when the vehicle speed is not lower than the first threshold speed Va (step S104, Yes), this shifts to step S110. On the other hand, when the vehicle speed is lower than the first threshold speed Va (step S104, No), the controller 111 shifts to step S105.

Next, at step S105, the controller 111 determines whether the vehicle speed is not lower than a second threshold speed Vd, and when the vehicle speed is not lower than the second threshold speed Vd (step S105, Yes), this shifts to step S106. On the other hand, when the vehicle speed is lower than the second threshold speed Vd (step S105, No), the controller 111 shifts to step S107.

At step S106 branched from positive determination at step S105, the controller 111 determines whether the damper function is in an on-state at the time at which it shifts to this step. When the damper function is in the on-state (step S106, Yes), the controller 111 shifts to step S110. On the other hand, when the damper function is not in the on-state (step S106, No), the controller 111 shifts to step S107.

At steps S104, S105, and S106 described above, it is determined whether to turn on the damper function based on a condition according to the vehicle speed. As described above at step S103, when the wheel loader 100 is operated at a low speed, it is considered that the work has a priority, so that it is more efficient that a relative position between the vehicle body and the working machine (such as the boom 102 and bucket 101) is fixed. When a determination value of the speed is one speed, hunting operation such as turn on/off of the damper function might occur at the time of the travel at a speed near this speed. Therefore, there are two threshold speeds in a viewpoint of providing hysteresis. Meanwhile, the first threshold speed Va is a speed value larger than the second threshold speed Vd.

A main flow illustrated in FIG. 6 is described again and step S110 branched from steps S104 and S106 at the time of the positive determination is to be described later.

At step S107, the controller 111 determines whether the current working status is the loaded state (St=3), and when it is not in the loaded state (step S107, No), this shifts to step S112 to turn off the damper function. On the other hand, as a result of the determination at step S107, when the current working status is the loaded state (St=3) (step S107, Yes), the controller 111 shifts to step S108.

At step S108, the controller 111 determines whether the boom angle is below the horizontal plane, which is the predetermined attitude, and when the boom angle is not below the horizontal plane (step S108, No), this shifts to step S112 to turn off the damper function. On the other hand, as a result of the determination, when the boom angle is below the horizontal plane (step S108, Yes), the controller 111 shifts to step S109 for checking a state in which the direction of the bucket 101 is operated. That is to say, the controller 111 determines whether the attitude of the boom 102 is controlled to be a predetermined attitude (attitude with the angle of elevation above the horizontal plane) from the boom angle obtained by a detection value from the boom angle sensor 102-11, and turns off the damper function when the boom 102 is controlled to be in the predetermined attitude.

It is determined whether stable travel is possible with the damper function turned on at this step. Since a heavy burden is loaded in the bucket in the loaded state (St=3), a barycentric position of the wheel loader 100 is lower when the boom is located on a lower position and the stable travel becomes possible. In such a case, the damper function is turned on. On the other hand, when the barycentric position is high, the damper function is turned off. There also is operation to load the burden into the loading platform of the dump truck 300 in a state in which the boom 102 is raised above the horizontal plane or substantially vertically. In such a case, when the damper function is in the on-state, the bucket position is unstable and a predetermined or longer time might be taken to approach the dump truck 300. That is to say, step S108 also is substantially the step at which it is determined whether to load the burden in the bucket 101 into the loading platform of the dump truck 300. By turning on/off the damper function based on a determination result at this step, it becomes possible to prevent occurrence of a defect such as contact of the boom 102 and the bucket 101 with the loading platform and the like of the dump truck 300 by swing of the boom 102, for example. Meanwhile, it goes without saying that a boom angle condition at this step and the boom angle condition of the transition condition to the loaded state (St=3) indicated in Table 1 may be identical to or different from each other, and they may be set according to an object.

Then, at step S109, the controller 111 detects from the bucket lever stroke signal to operate the direction of the bucket 101 to determine whether the bucket lever stroke is not smaller than a first threshold stroke. As a result of the determination at step S109, when the bucket lever stroke is smaller than the first threshold stroke (step S109, No), the controller 111 shifts to step S112 to turn off the damper function. On the other hand, as the result of the determination, when the bucket lever stroke is not smaller than the first threshold stroke (step S109, Yes), the controller 111 shifts to step S110.

The bucket lever stroke signal indicates the operation in a tilt direction and the operation in a dump direction by positive and negative values, respectively, and it is set such that the absolute values thereof becomes larger as the operation amount of the lever is larger. The bucket lever stroke signal at the time of neutral, that is to say, when there is no operation of the bucket lever is set to 0. Herein, the first threshold stroke is set to an optional value in the dump direction (negative value). This is for allowing small dump operation and tilt operation when performing operation to arrange a shape of the loaded burden and determining that large operation of the bucket 101 in the dump direction is performed. In this manner, by allowing the first threshold stroke to have a certain degree of margin with respect to neutral, this serves as the threshold for determining whether the operator of the wheel loader is to discharge the burden in the bucket 101.

Meanwhile, it is not required to determine at steps S108 and S109 described above in this order and the order may be changed. Further, it may be said that it is determined to turn off the damper function at the time of the operation to load the burden into the truck 300 at both of two steps, so that there is a modified example to integrate them into a step at which it is determined whether to be in a loading state by further providing a switch indicating transition to the "loading state" to check on/off and by providing a "loading state" as the working state illustrated in Table 1 to allow the transition of the state according to conditional determination at steps S108 and S109.

Next, at step S110, the controller 111 detects from the boom lever stroke signal, which operates the angle of elevation of the boom 102 (boom angle), and determines whether the boom lever stroke is not smaller than a second threshold stroke. Meanwhile, it shifts to this step not only from step S109 but also from the determination to turn on the damper function at steps S104 and S106 described above.

The boom lever stroke signal determined at this step S110 is set such that the signal in a neutral state without the operation is 0, the operation to raise the boom and the operation to lower the boom are represented by the positive and negative values, respectively, and the larger the operation amount of the lever, the larger the absolute value thereof. The second threshold stroke value is set to a negative value. That is to say, a state in which the value is smaller than the second threshold stroke value is a state in which large and rapid lowering of the boom is performed.

In such operation, the pressurized oil on the bottom side of the lift cylinder is rapidly drained, so that pressure of the pressurized oil on the bottom side becomes the pressure near atmosphere pressure. Therefore, when the damper function is in the on-state, pressure in the accumulator 117 connected to the bottom side is decreased to the pressure near the atmosphere pressure. A case in which the damper function is turned off and then turned on in this state is considered. The damper function is turned on when it transits to the loaded state (St=3), so that the hydraulic pressure capable of bearing a weight of the burden is generated on the bottom side of the lift cylinder. Then, if the pressure in the accumulator is substantially 0 (near the atmosphere pressure) when the damper function is turned on, the pressurized oil on the bottom side flows into the accumulator, and as a result, a phenomenon that the boom is temporarily lowered occurs. It is required that the accumulator 117 maintains certain pressure in order to decrease the lowering phenomenon and prevent the operator from feeling discomfort when the dump function is turned on. Then, at step S110, it is determined that the boom is rapidly lowered when the operation signal of the boom stroke lever is smaller than the second threshold stroke value to turn off the damper function. According to this, the communication of the pressurized oil between the bottom side and the accumulator is blocked. However, since step S110 is for obtaining the above-described function, this may be made the step to make the detected pressure of the bottom pressure detector 119 the signal to turn off the damper function when a pressure value is not larger than an optional threshold.

Then, as a result of the determination at step S110, when the boom lever stroke is smaller than the second threshold stroke (step S110, No), the controller 111 shifts to step S112 to turn off the damper function. On the other hand, when the boom lever stroke is not smaller than the second threshold stroke as the result of the determination at step S110 (step S110, Yes), the controller 111 turns on the damper function (step S111), and thereafter shifts to step S113. When the damper function is turned off at step S112, the controller 111 thereafter shifts to step S113.

At step S113, the controller 111 determines whether an instruction to finish the damper operation control process is input by a key switch and the like not illustrated (step S113), and when the instruction to finish is input (step S113, Yes), this finishes this damper operation control process. On the other hand, when the instruction to finish is not input (step S114, No), the controller 111 returns back to step S102 to repeat the process at step S102 and subsequent steps described above.

By operating in the above-described manner, in this embodiment, when the working status is the loaded state (St=3), the damper function is turned on irrespective of the vehicle speed, so that it is possible to prevent the burden in the bucket 101 from falling and ride quality during the travel from being deteriorated by the vibration and the like generated in the boom 102 and the like at the time of the turn. Also, in this embodiment, the damper function is turned off according to the angle (angle of elevation) of the boom 102, so that it is possible to prevent contact of the boom 102 and the bucket 101 with the dump truck 300 by the vibration and the like of the boom 102 generated when loading the burden into the loading platform of the dump truck 300. Further, in this embodiment, in a case in which the working status is other than the loaded state (St=3) (step S107, No), when the wheel loader 100 travels at a predetermined speed (first threshold speed Va or second threshold speed Vd) or higher (step S104, Yes or step S105, Yes), the damper mechanism is activated, and in a case of the loaded state (St=3) (step S107, Yes), the damper mechanism is activated even when the speed of the wheel loader 100 is lower than the predetermined speed (first threshold speed Va or second threshold speed Vd) (step S104, No or step S105, No). Therefore, it becomes possible to adequately activate/deactivate the damper function according to the working state such as the excavation work and carrying work.

Figure 7:
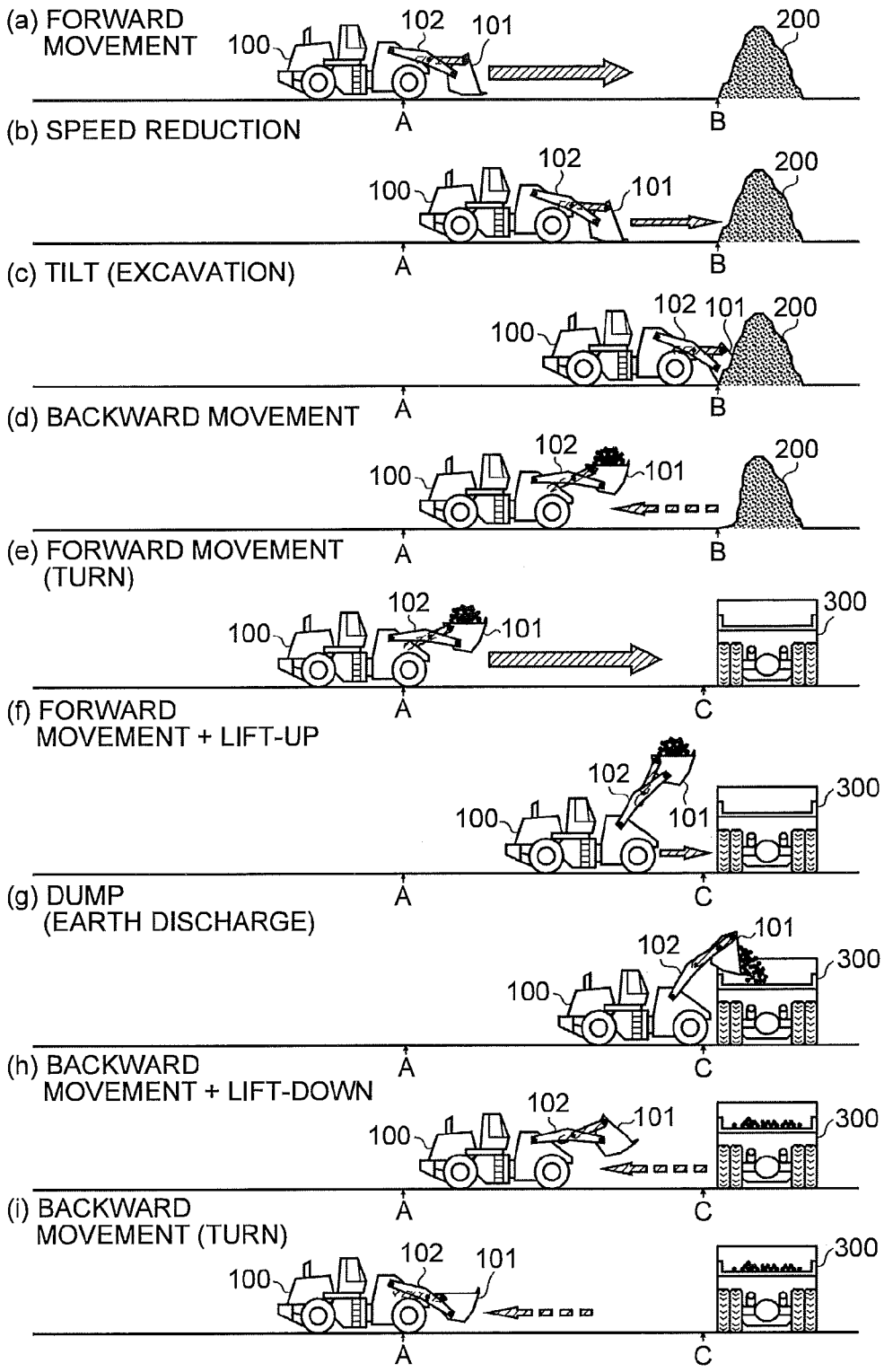
FIG. 7 is a view illustrating the schematic flow of the loading work illustrated in FIG. 1.
Figure 8:
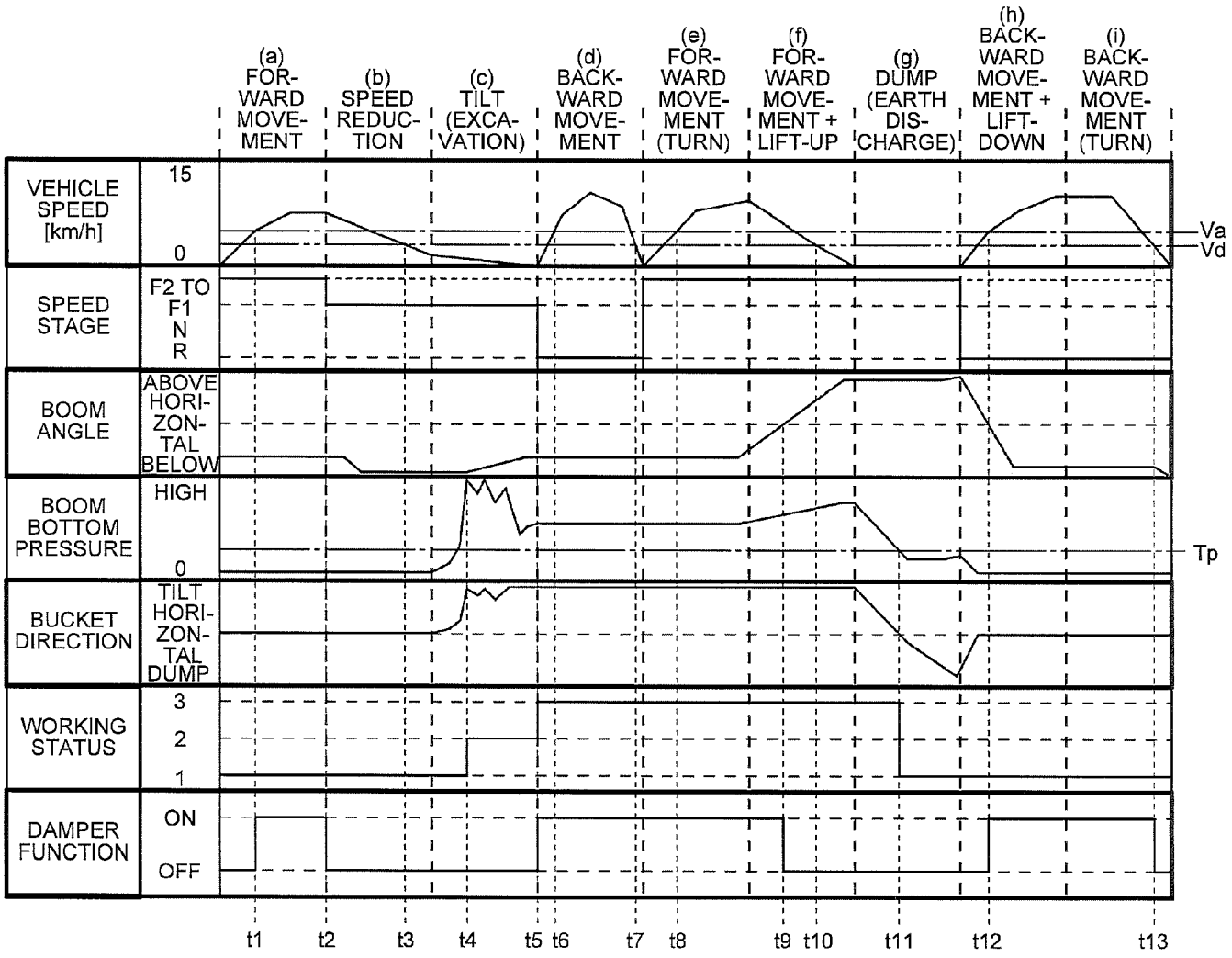
FIG. 8 is a sequence diagram illustrating change in parameters in a process illustrated in FIG. 7.

Next, a flow of the loading work illustrated in FIG. 1 is described in detail as a specific example with reference to the drawings. FIG. 7 is a view for illustrating a schematic flow of the loading work illustrated in FIG. 1. FIG. 8 is a sequence diagram illustrating change in each parameter in a process illustrated in FIG. 7.

As illustrated in FIG. 7, in the loading work illustrated in FIG. 1, the wheel loader 100 first moves forward from the start position A toward the excavation position B just before the mound 200 (FIG. 7(*a*)). In this process, as illustrated in FIG. 8(*a*), the working status is the unladen state (St=1) and the wheel loader 100 starts moving forward with a shift gear not lower than a forward second speed (F2), and thereafter, the vehicle speed becomes the first threshold speed Va or higher at timing t1. The controller 111 of the wheel loader 100 turns on the damper function on the condition that the vehicle speed becomes the first threshold speed Va or higher at the timing t1.

Next, the wheel loader 100 starts reducing the speed before the excavation position B (FIG. 7(*b*)). In this process, as illustrated in FIG. 8(*b*), the working status is the unladen state (St=1). The wheel loader 100 shifts from the shift gear not lower than the forward second speed stage (F2) to the forward first speed stage (F1) at timing t2, so that the controller 111 turns off the damper function at the timing t2. Thereafter, the vehicle speed is reduced from the vehicle speed not lower than the first threshold speed Va and further becomes the vehicle speed not higher than the second threshold speed Vd at timing t3. Meanwhile, in the process illustrated in FIG. 7(*b*), the wheel loader 100 reduces the speed in a state of lowering the boom 102 while maintaining the direction of the bucket 101 horizontally such that the bucket 101 is brought into contact with the ground.

Next, when the wheel loader 100 arrives at the excavation position B, this lifts up (lifts off) and tilts the bucket 101 several times, thereby excavating the mound 200 by the bucket 101 to load the earth and sound in the bucket 101 (FIG. 7(*c*)). In this process, as illustrated in FIG. 8(*c*), the working status is initially the unladen state (St=1) and the wheel loader 100 sticks the bucket 101 to the mound 200 at timing t4 in a state in which the bucket 101 is brought into contact with the ground. At that time, the boom bottom pressure drastically increases at the timing t4. The controller 111 detects the drastic increase in the boom bottom pressure and allows the working status to transit from the unladen state (St=1) to the state during the excavation work (St=2) (refer to FIG. 1 and Table 1). Thereafter, the wheel loader 100 tilts the bucket 101 several times (turns the bucket opening upward) while gradually increasing the boom angle (lifting up) to load the earth and sand in the bucket 101. Therefore, the boom bottom pressure at that time changes according to the lift-up and the tilt.

Next, the wheel loader 100 moves backward in a state in which the earth and sand are loaded in the bucket 101, thereby returning to the vicinity of the start position A (FIG. 7(*d*)). In this process, as illustrated in FIG. 8(*d*), the working status is the state during the excavation work (St=2) and the wheel loader 100 starts moving backward after the shift lever mechanism is moved to reverse (R) at timing t5 and thereafter stops in the vicinity of the start position A. At that time, the vehicle speed becomes the first threshold speed Va or higher at timing t6, and thereafter, the vehicle speed becomes the second threshold speed Vd or lower at timing t7. The controller 111 detects that the shift lever mechanism is moved to reverse at the timing t5 and allows the working status to transit from the state during the excavation work (St=2) to the loaded state (St=3) (refer to FIG. 1 and Table 1). The controller 111 turns on the damper function. However, the controller 111 does not turn off the damper function at timing t7 even when the vehicle speed becomes the second threshold speed Vd or lower because the working status is the loaded state (St=3) (refer to Table 1). According to this, it becomes possible to decrease the vibration generated in the boom 102 at the time of the turn, and as a result, falling of the burden from the bucket 101 and deterioration in the riding quality may be decreased.

Next, the wheel loader 100 moves toward the earth discharge position C beside the loading platform of the dump truck 300 by moving forward while turning (FIG. 7(*e*)) and subsequently reduces the speed while lifting up the bucket 101 to a target height (for example, height equal to or higher than the loading platform of the dump truck 300) by driving the boom 102, thereby moving to the earth discharge position C beside the loading platform of the dump truck 300 (FIG. 7(*f*)). In the process illustrated in FIG. 7(*e*), as illustrated in FIG. 8(*e*), first, the working status is the loaded state (St=3) and the wheel loader 100 starts moving forward with the shift gear not lower than the forward second speed (F2), and thereafter, the vehicle speed becomes the first threshold speed Va or higher at timing t8. However, since the damper function is already turned on at the timing t8, the controller 111 maintains the on-state. Subsequently, in the process illustrated in FIG. 7(*f*), as illustrated in FIG. 8(*f*), the wheel loader 100 starts reducing the speed with the shift gear in the forward second speed and lifts up the boom 102, and thereafter, the angle of the boom 102 is horizontal or above the horizontal plane at timing t9. The controller 111 turns off the damper function on the condition that the angle of the boom is horizontal or above the horizontal plane at the timing t9. According to this, the vibration of the boom 102 relative to the vehicle body of the wheel loader 100 is less likely to be generated, so that it becomes possible to prevent the contact of the boom 102 and the bucket 101 with the dump truck 300 by the vibration generated in the boom 102 when the wheel loader 100 approaches the dump truck 300. Meanwhile, although the vehicle speed becomes the second threshold speed Vd or lower at subsequent timing t10, the damper function is already turned off at the timing t10.

Next, the wheel loader 100 discharges the earth and sand in the bucket 101 into the loading platform of the dump truck 300 by dumping the bucket 101 in the earth discharge position C (FIG. 7(*g*)). In this process, as illustrated in FIG. 8(*g*), the working status is initially the loaded state (St=3), and thereafter, the boom bottom pressure becomes threshold pressure Tp or lower at timing t11 because the earth and sand in the bucket 101 are gradually discharged. The controller 111 detects that the boom bottom pressure becomes the threshold pressure Tp or lower and allows the working status to transit from the loaded state (St=3) to the unladen state (St=1).

Next, the wheel loader 100 starts moving backward from the earth discharge position C and lifts down and tilts the bucket 101 by driving the boom 102 (FIG. 7(*h*)). In this process, as illustrated in FIG. 8(*h*), the working status is the unladen state (St=1) and the wheel loader 100 starts moving backward, and thereafter, the vehicle speed becomes the first threshold speed Va or higher at timing t12. The controller 111 turns on the damper function on the condition that the vehicle speed becomes the first threshold speed Va or higher at the timing t12. However, the boom angle is set to the predetermined angle (for example, 20 degrees) or smaller before the timing t12.

Next, the wheel loader 100 starts reducing the speed in the vicinity of the start position A and thereafter stops at the start position A (FIG. 7(*i*)). In this process, as illustrated in FIG. 8(*i*), the working status is the unladen state (St=1) and the wheel loader 100 starts reducing the speed and the vehicle speed becomes the second threshold speed Vd or lower at timing t13. The controller 111 turns off the damper function on the condition that the vehicle speed becomes the second threshold speed Vd or lower at the timing 13.

One cycle of the excavation work and earth discharging work (loading work) is finished through the above-described processes. The wheel loader 100 repeats the cycle at least once to load a target amount of earth and sand into the loading platform of the dump truck 300.

Meanwhile, although the switching valve control unit 111B turns on the damper function also at times other than the time at which the state detecting unit 111A detects that the state is the loaded state in the above-described embodiment, there is no limitation and it is also possible that the damper function is turned on when the state detecting unit 111A detects that the state is the loaded state.

The above-described embodiment and the modified example thereof are merely examples for carrying out the present invention. The present invention is not limited thereto and various modifications according to specification and the like fall within the scope of the present invention, and further, it is obvious from the description above that other various embodiments are possible within the scope of the present invention. For example, it goes without saying that the modified example appropriately illustrated for each embodiment may also be applied to another embodiment.

For example, although the wheel loader is described as an example of the working vehicle in the above-described embodiment, the present invention is not limited thereto and may be applied to various working vehicles such as a skid-steer loader and a excavator. Also, although the working vehicle (wheel loader 100) equipped with a hydraulic system in which the hydraulic oil is used as a transmitting medium of the drive force from the power supply is described as an example in the above-described embodiment, there is no limitation and it is also possible to apply the present invention to the working vehicle equipped with a fluid pressure system in which water and another liquid are used as the transmitting medium of the drive force.

REFERENCE SIGNS LIST

100 Wheel Loader
101 Bucket
102 Boom
118-1, 121-1 Tube
118-3, 121-3 Piston Rod
102-11 Boom Angle Sensor
103 Front Wheel
110 Damper Operation Control Device
111 Controller
111A State Detecting Unit
111B Switching Valve Control Unit
112A Shift Operation Detector
112B Damper Function Switch
112C Boom Operating Lever Operation Amount Sensor
112D Bucket Operating Lever Operation Amount Sensor
113 Vehicle Speed Sensor
114 Fluid Reservoir
115 Valve System
115-1 Solenoid Coil
115*a* Switching Valve
115*b* Epc Valve
116 Pilot Pressure Supply Source
117 Accumulator
118 Lift Cylinder
119 Bottom Pressure Detector
120 Transmission
121 Bucket Cylinder
122 First Bucket Link
122-1, 122-3 Link Pin
122-2 Support Pin
122-11 Bucket Angle Sensor
123 Support Member
124 Second Bucket Link
130 Vehicle Body Front Frame
140 Operating Valve
141 Hydraulic Pump
145 Main Oil Passage
146, 146*a* Branched Oil Passage
200 Mound
300 Dump Truck
A Start Position
B Excavation Position
C Earth Discharge Position

The invention claimed is:

1. A damper operation control device of a working vehicle, comprising:
- a boom pivotably supported on a vehicle body;
- a bucket pivotably supported on a tip end of the boom;
- a lift cylinder which drives the boom;
- an accumulator connected to the lift cylinder through a branched oil passage;
- a switching valve connected to the branched oil passage between the lift cylinder and the accumulator, the switching valve switching between a connected state and a disconnected state between the lift cylinder and the accumulator;
- a transmission for driving; and
- a controller which performs switch control of the switching valve, wherein the controller includes:
- a state detecting unit which detects whether the bucket is in a loaded state based on at least one of the bottom pressure of the lift cylinder, the attitude angle of the boom, the direction of the bucket, and a shift operation signal for operating the transmission; and
- a switching valve control unit which
  - switches the switching valve to the connected state when the working vehicle travels at a speed not lower than a predetermined speed when the state detecting unit detects that the bucket is in a state other than the loaded state, and
  - switches the switching valve to the connected state even when the working vehicle travels at a speed lower than the predetermined speed when the state detecting unit at least determines that an attitude angle of the boom is below a horizontal plane and detects that the bucket is in the loaded state, and
  - the switching valve control unit switches the switching valve to the disconnected state when the shift operation signal indicates a predetermined stage which is a forward first speed stage or gear at a time of an excavation work.

2. The damper operation control device of the working vehicle according to claim 1, wherein the state detecting unit detects a transition state of at least an unladen state, a state during excavation work, and the loaded state as a working state of the working vehicle, and the switching valve control unit switches the switching valve to the connected state when the working state of the working vehicle is the loaded state.

3. The damper operation control device of the working vehicle according to claim 1, wherein the switching valve control unit switches the switching valve to the disconnected state when the boom is detected to be controlled to be in a predetermined attitude.

4. The damper operation control device of the working vehicle according to claim 1, wherein the switching valve control unit switches the switching valve to the disconnected state based on an operation amount of an operating lever which operates a direction of the bucket, and/or an operation amount of an operating lever which operates an attitude of the boom.

5. The damper operation control device of the working vehicle according to claim 1, wherein the switching valve control unit switches the switching valve to the connected state when a bucket lever stroke of a bucket lever to operate a direction of the bucket is not smaller than a predetermined threshold stroke.

6. A damper operation control method for a working vehicle, the working vehicle including:

a boom pivotably supported on a vehicle body;

a bucket pivotably supported on a tip end of the boom;

a lift cylinder which drives the boom through a branched oil passage;

an accumulator connected to the lift cylinder;

a switching valve connected to the branched oil passage between the lift cylinder and the accumulator, the switching valve switching between a connected state and a disconnected state between the lift cylinder and the accumulator;

a transmission for driving; and a controller which performs switch control of the switching valve, the method comprising:

detecting, by a controller, whether the bucket is in a loaded state based on at least one of the bottom pressure of the lift cylinder, the attitude angle of the boom, the direction of the bucket, and a shift operation signal for operating the transmission; and switching, by the controller, the switching valve to the connected state when the working vehicle travels at a speed not lower than a predetermined speed which is a forward first speed stage or gear when the state detecting unit at least determines that an attitude angle of the boom is below a horizontal plane and detects that the bucket is in a state other than the loaded state, and switching the switching valve to the connected state even when the working vehicle travels at a speed lower than the predetermined speed when the state detecting unit detects that the bucket is in the loaded state.

7. The damper operation control method according to claim 6, wherein the working vehicle further includes a transmission for driving, the detecting includes detecting a transition state of at least an unladen state, a state during excavation work, and the loaded state as a working state of the working vehicle and detecting that a current working state of the working vehicle is the loaded state when a bottom pressure of the lift cylinder is detected to be not lower than predetermined unladen pressure for determining that a burden is not loaded in the bucket and an angle of the boom is detected to be smaller than a predetermined angle set in advance or when the bottom pressure of the lift cylinder is detected to be not lower than the predetermined unladen pressure and a direction of the bucket is detected to be horizontal or above a horizontal plane in a case that the current working state of the working vehicle is the unladen state, or when an operation signal to the transmission is detected to be other than forward in a case that the current working state of the working vehicle is the state during the excavation work.

8. The damper operation control method according to claim 6, further comprising: detecting whether the boom is controlled to be in a predetermined attitude and switching the switching valve to the disconnected state when the boom is detected to be not controlled to be in the predetermined attitude.

9. The damper operation control method according to claim 6, further comprising: switching the switching valve to the disconnected state when the transmission is in a predetermined stage.

10. A damper operation control device of a working vehicle, comprising:

a boom pivotably supported on a vehicle body;

a bucket pivotably supported on a tip end of the boom;

a lift cylinder which drives the boom;

an accumulator connected to the lift cylinder through a branched oil passage;

a switching valve connected to the branched oil passage between the lift cylinder and the accumulator, the switching valve switching between a connected state and a disconnected state between the lift cylinder and the accumulator;

a transmission for driving; and a controller which performs switch control of the switching valve, wherein the controller includes:

a state detecting unit which detects whether the bucket is in a loaded state based on at least one of the bottom pressure of the lift cylinder, the attitude angle of the boom, the direction of the bucket, and a shift operation signal for operating the transmission; and a switching valve control unit which switches the switching valve to the connected state when the working vehicle travels at a speed not lower than a predetermined speed when the state detecting unit detects that the bucket is in a state other than the loaded state, and switches the switching valve to the connected state even when the working vehicle travels at a speed lower than the predetermined speed when the state detecting unit at least determines that an attitude angle of the boom is below a horizontal plane and detects that the bucket is in the loaded state.

11. The damper operation control device of the working vehicle according to claim 10, wherein the switching valve control unit switches the switching valve to the connected state when a bucket lever stroke of a bucket lever to operate a direction of the bucket is not smaller than a predetermined threshold stroke.

* * * * *